US006024109A

United States Patent [19]

Lin et al.

[11] Patent Number: 6,024,109

[45] Date of Patent: Feb. 15, 2000

[54] RELIABLY CONTROLLABLE WINDPROOF UMBRELLA

[75] Inventors: Chung-Kuang Lin, Taipei; Jung-Jen Chang, Taipei Hsien, both of Taiwan

[73] Assignee: Fu Tai Umbrella Works, Ltd., Taipei Hsien, Taiwan

[21] Appl. No.: 09/128,723

[22] Filed: Aug. 3, 1998

[51] Int. Cl.[7] ..... A45B 25/26

[52] U.S. Cl. ..... 135/33.7; 135/32; 135/31; 135/29

[58] Field of Search ..... 135/29, 32, 33.7, 135/25.31, 25.32, 31

[56] References Cited

U.S. PATENT DOCUMENTS

| | | | |
|---|---|---|---|
| 1,027,426 | 5/1912 | McClellan | 135/32 |
| 3,960,162 | 6/1976 | Noel | 135/33.7 |
| 4,979,534 | 12/1990 | Johnson et al. | 135/33.7 |
| 5,078,166 | 1/1992 | Lee | 135/33.7 |
| 5,115,827 | 5/1992 | Lee | 135/33.7 |
| 5,601,103 | 2/1997 | Dubinsky | 135/33.7 |
| 5,640,984 | 6/1997 | Dubunsky | 135/33.7 |

*Primary Examiner*—Carl D. Friedman
*Assistant Examiner*—Winnie Yip

[57] ABSTRACT

A windproof umbrella includes: an upper cloth secured on an upper rib pivotally connected to a central shaft of the umbrella, a lower cloth secured on a lower rib pivotally connected to the central shaft and having a central opening circumferentially formed in a top portion of the lower cloth around the central shaft, each upper cloth provided with a control valve thereon for resiliently normally closing an aperture between the upper cloth and the lower cloth; and upon blowing of strong wind on the lower and upper cloths, the control valve will be opened to release the wind for preventing inversion of the umbrella.

11 Claims, 9 Drawing Sheets

FIG. 1

RELIABLY CONTROLLABLE WINDPROOF UMBRELLA

BACKGROUND OF THE INVENTION

U.S. Pat. No. 4,979,534 to Johnson et al. disclosed a windproof umbrella having a lower canopy with vent holes and an upper canopy in covering relation to the vent holes to provide air escape during high winds so as to prevent inversion of the umbrella.

Johnson's prior art is illustrated in FIG. 22, in which the upper canopy (36) is resiliently secured to the tips (28) by elastic straps (48), and the lower canopy (20) is secured on the ribs (18) which are pivotally connected with the struts (16) at points (P) and the runner held on the shaft. Upon wind (W) blowing through the vent holes 34, the air will escape through the aperture between the upper canopy (36) and the lower canopy (20) by forcibly stretching the elastic straps (48). Since the lower (outer) end portion of each strap (48) is distantly separated from the pivotal connection point (P), a great arm of force as effected by strong or high winds will exert a great moment acting upon the pivotal connection points (P) to cause breaking from such points (P), thereby easily breaking and damaging the ribs of the umbrella of the prior art.

The present inventor has found the drawbacks of the conventional windproof umbrella and invented the present windproof umbrella which can be reliably controlled.

SUMMARY OF THE INVENTION

The object of the present invention is to provide a windproof umbrella including: an upper cloth secured on an upper rib pivotally connected to a central shaft of the umbrella, a lower cloth secured on a lower rib pivotally connected to the central shaft and having a central opening circumferentially formed in a top portion of the lower cloth around the central shaft, each upper cloth provided with a control valve thereon for resiliently normally closing an aperture between the upper cloth and the lower cloth; and upon blowing of strong wind on the lower and upper cloths, the control valve will be opened to release the wind for preventing inversion of the umbrella.

DETAILED DESCRIPTION

Figures 1, 2, 3:
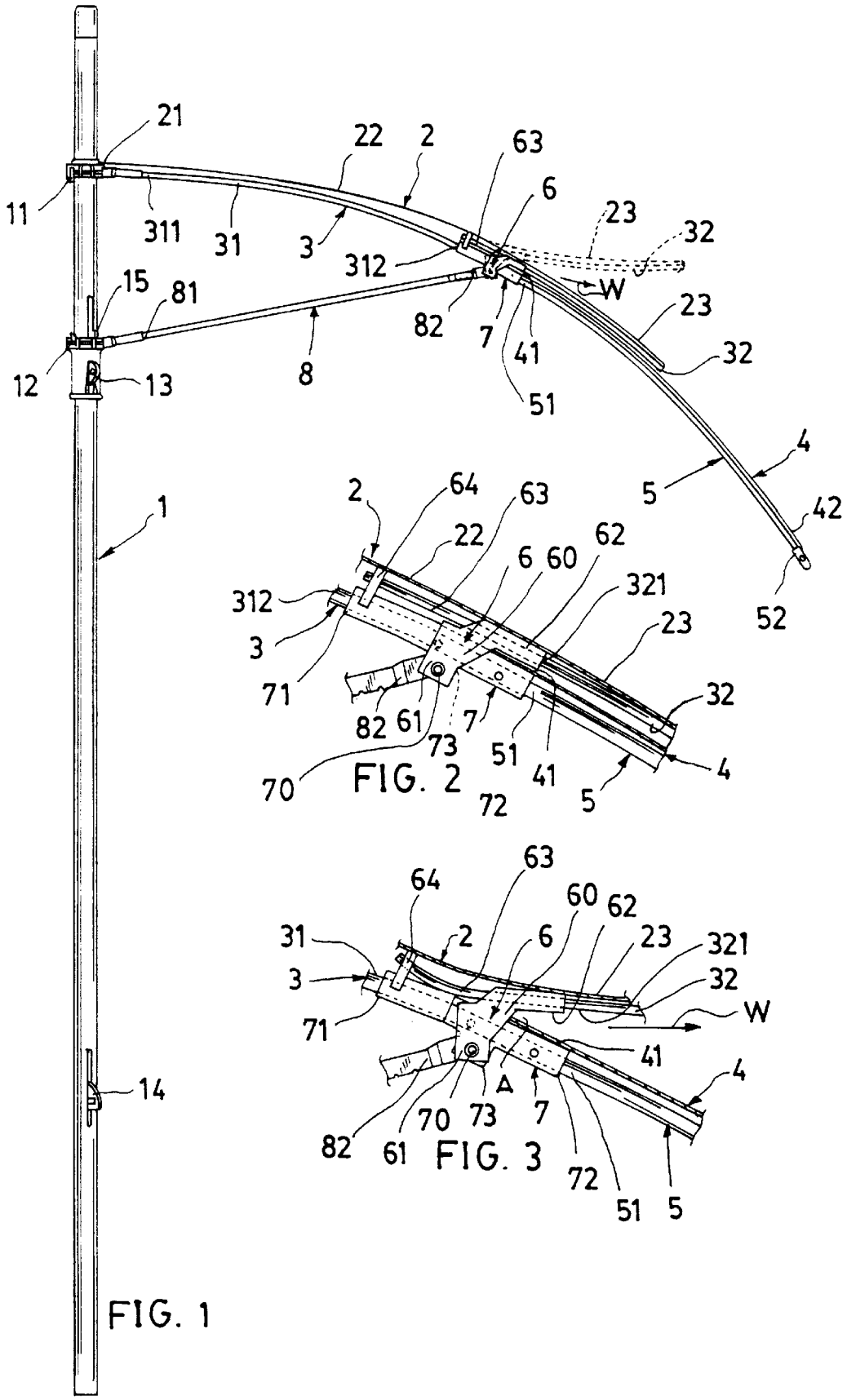
FIG. 1 is an illustration showing an opening umbrella of the present invention.
FIG. 2 shows the control valve of the present invention when the valve is "closed".
FIG. 3 shows an opening control valve in accordance with the present invention.

As shown in FIGS. 1~6, the present invention comprises: a central shaft 1, an upper cloth 2 secured on an upper rib 3 which is pivotally connected to the central shaft 1, a lower cloth 4 secured on a lower rib 5 which is pivotally connected to the central shaft 1, and each upper rib 3 having a control valve 6 formed thereon for closing or opening an aperture A between the upper cloth 2 and the lower cloth 4.

The central shaft 1 includes an upper notch 11 fixed on an upper portion of the shaft 1, a lower runner 12 slidably held on the shaft 1, an upper catch 13 resiliently formed on an upper portion of the shaft, a lower catch 14 resiliently formed on a lower portion of the shaft, and a stopper 15 secured on an upper portion of the shaft 1 and positioned above the upper catch 13.

The upper cloth 2 has its inner portion 21 secured to the upper notch 11 of the central shaft 1, an intermediate portion 22 secured on a top rip portion 31 of the upper rib 3 and an outer flap portion 23 formed on an outer portion of the upper cloth 2 to be secured on a flap rib portion 32 of the upper rib 3.

The lower cloth 4 has its inner tip portion 41 secured on a joint member 7 provided for joining the top rib portion 31 formed on a top portion of the upper rib 3 and the lower rib 5, a peripheral portion 42 secured on an outer rib portion 52 of the lower rib 5, and a central opening 43 circumferentially formed on a top portion of the lower cloth 4 about the central shaft 1. The central opening 43 may be formed as a polygonal shape, a poly-lobe shape or other suitable shapes, not limited in the present invention. The top central opening 43 of the lower cloth 4 will be covered by the upper cloth 2 when assembled.

The joint member 7 includes an inner sleeve portion 71 for securing an outer end of the top rib portion 31 of the upper rib 3, an outer sleeve portion 72 for securing an inner rib portion 51 of the lower rib 5, a lug 73 for pivotally connecting, by a pivot 70, an outer portion 82 of a stretcher rib 8 having an inner portion 81 pivotally secured to the lower runner 12 which is locked on the upper catch 13 when opening the umbrella and upwardly limited by the stopper 15 as shown in FIG. 1.

The top rib portion 31 of the upper rib 3 has its inner end 311 pivotally connected to the upper notch 11 and having an outer end 312 of the top rib portion 31 fixed to the inner sleeve portion 71 of the joint member.

The control valve 6 includes: a biasing member 60 having its base portion 60 pivotally connected to the lug 73 of the joint member 7 by the pivot 70, a sleeve portion 62 protruding from the base portion 61 to be generally parallel to the outer sleeve portion 72 of the joint member 7 when the upper cloth 2 closing the lower cloth 4 as shown in FIG. 2, a restoring spring 63 secured on an inner portion of the sleeve portion 62 and fixed to the inner sleeve portion 71 of the joint member 7 by a retainer 64 for normally resiliently urging the sleeve portion 62 to be closely juxtapositioned to the outer sleeve portion 72 of the joint member 7 for closing the upper cloth 2 (the outer flap portion 23) on the lower cloth 4 (FIG. 2).

The flap rib portion 32, formed on an outer (lower) portion of the top rib portion 31 of the upper rib 3, has an inner end 321 of the flap rib portion 32 secured to the sleeve portion 62 of the control valve 6 for securing the outer flap portion 23 of the upper cloth 2 on the flap rib portion 32.

The restoring spring 63 of the control valve 6 may be formed in situ by directly extending the inner end 321 of the flap rib portion 32 inwardly to be retained on the retainer 64 fixed on the joint member 7. The length of the flap rib portion 32 is preferably less than one half of the radial length of the lower cloth 4 from the opening 43 to a peripheral portion 42 of the cloth 4.

The flap rib portion 32 of the upper rib 3 should be made of resilient material having good elasticity.

Upon blowing of a strong wind W, the outer flap portion 23 of the upper cloth 2 as secured on the flap rib portion of the upper rib 3 will be raised upwardly to open the control valve 6 and the aperture A between the upper cloth 2 and the lower cloth 4 to release the strong wind W (FIG. 3) to prevent inversion of the umbrella cloths 2, 4. After the strong wind has been gone, the resilience of the restoring spring 63 of the control valve 6 will automatically restore the flap rib portion 32 and the outer flap portion 23 of the upper cloth 2 to close the aperture A between the upper and lower cloths 2, 4 (FIG. 2).

When the control valve is opened by the strong wind W as shown in dotted line of FIG. 1 and FIG. 3, the wind force will act upon the joint member 7, the upper rib 3 and the stretcher rib 8; which however will be instantly transferred to the upper notch 11 and the runner 12 on the central shaft 1. Then the force will be homogeneously shared by the notch 11, the runner 12 and the stopper 15, thereby being weakened and counteracted gradually without damaging the umbrella.

The length of the flap rib portion 32 is very short to have a short "arm of force" when subjected to wind force, thereby decreasing the momentum acting upon the control valve 6 and joint member 7 and preventing damage to the umbrella in comparison with the conventional windproof umbrella such as the umbrella of U.S. Pat. No. 4,979,534. The present invention thus provides a windproof umbrella which can be operated and controlled more reliably, thereby prolonging the service life of the umbrella.

Figure 5:
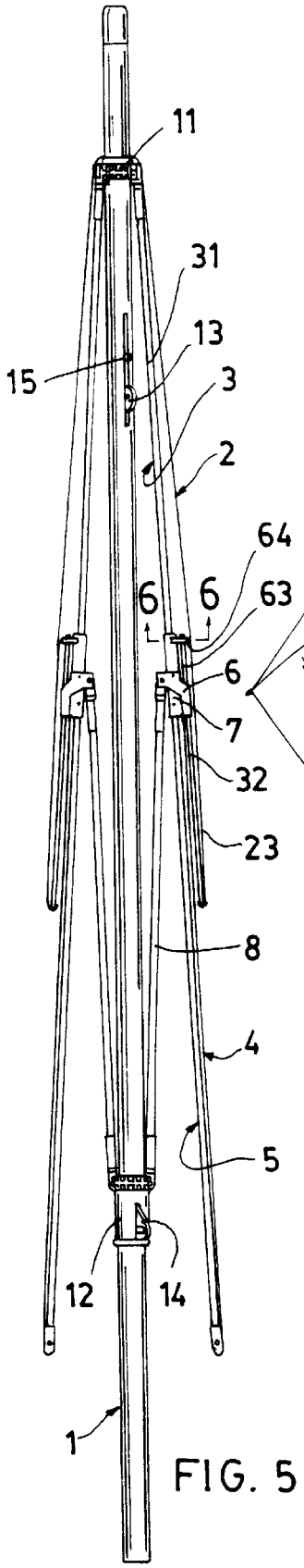
FIG. 5 shows a folded umbrella of the present invention.
Figure 4:
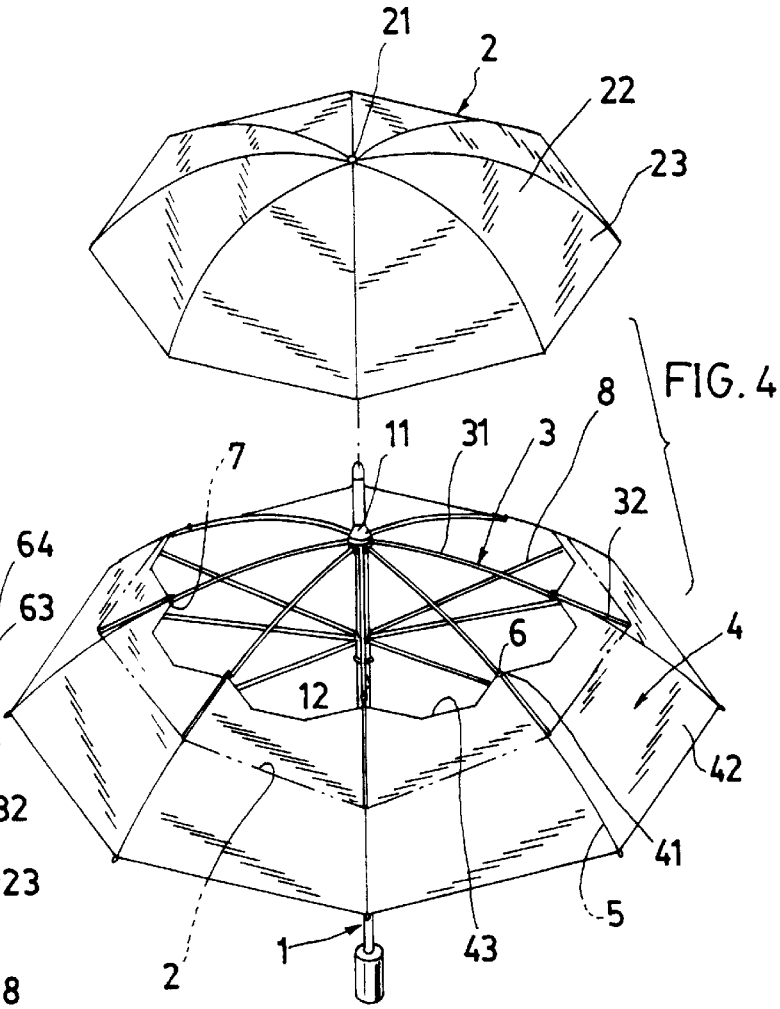
FIG. 4 is an exploded view of the present invention.
Figure 6:
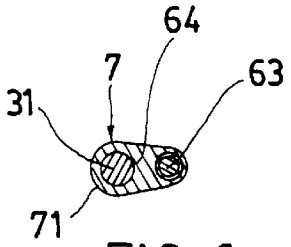
FIG. 6 is a cross sectional drawing when viewed from 6—6 direction of FIG. 5.

When folded, the runner 12 will be engaged with the lower catch 14 as shown in FIG. 5. The top rib portion 31 of the upper rib 3 and the lower rib 5 may also be integrally formed as a linear rod if the mechanical strength is durable and allowable.

Another preferred embodiment of the present invention is shown in FIGS. 7~11, in which each control valve 6 is modified to include a biasing member 60 having a base portion 61 integrally formed on a top of the joint member 7 and having a sleeve portion 62 for securing the flap rib portion 32 of the upper rib 3 into the sleeve portion 62.

Figures 7, 8, 9:
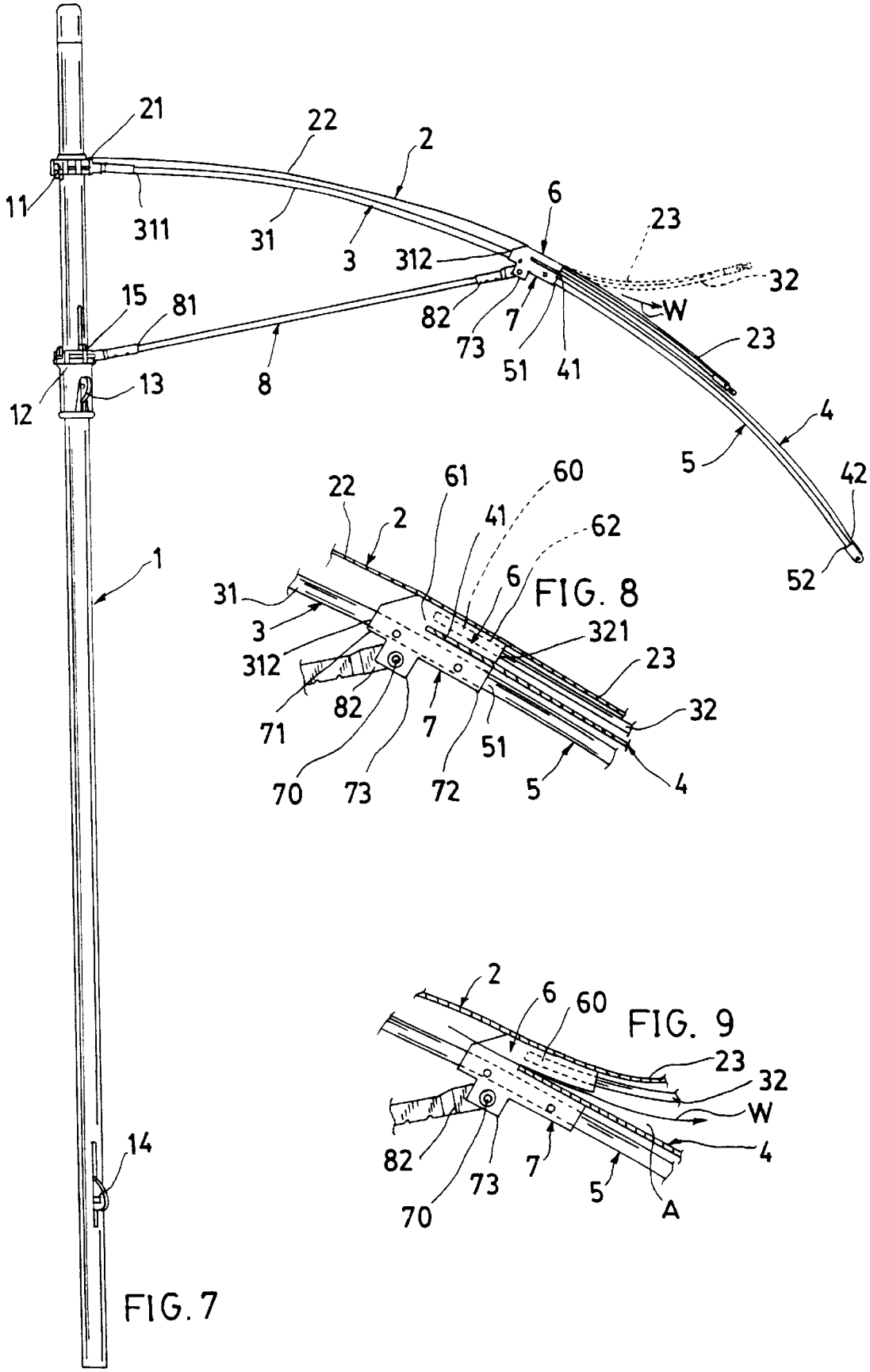
FIG. 7 shows another preferred embodiment of the present invention when opened.
FIG. 8 shows the control valve of FIG. 7 when closed.
FIG. 9 shows the opening valve of FIG. 7.
Figure 11:
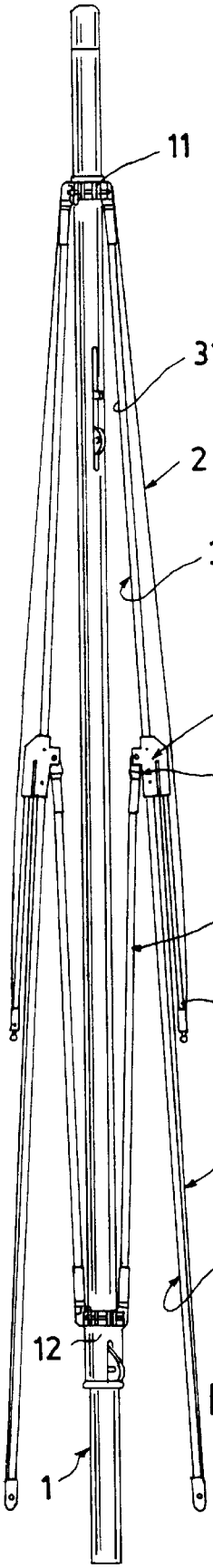
FIG. 11 shows a folded umbrella from FIG. 7.
Figure 10:
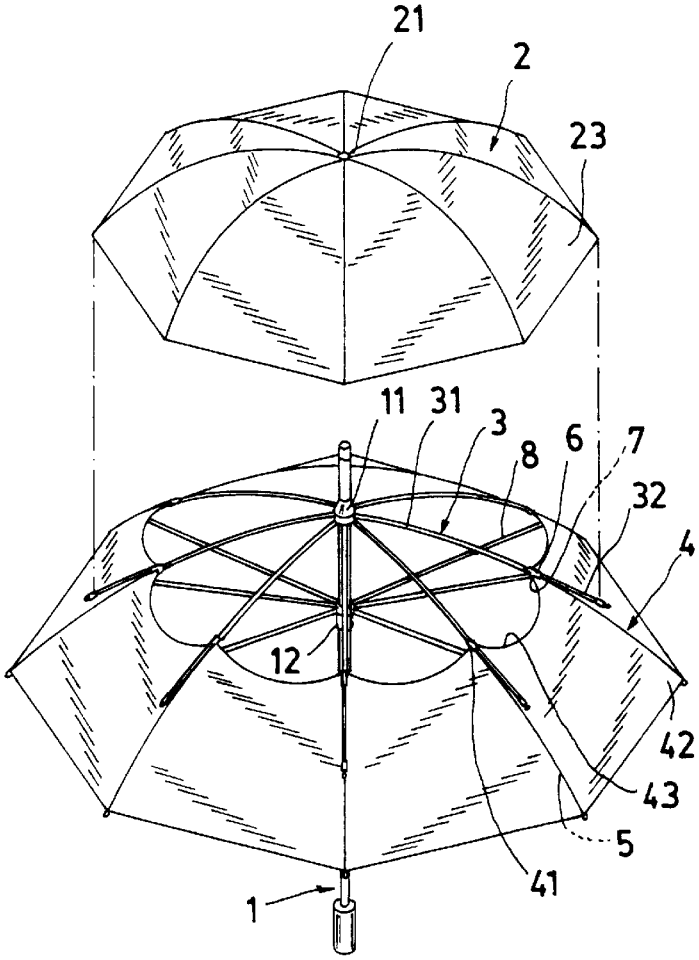
FIG. 10 is an exploded view of FIG. 7.

The control valve 6 and the joint member 7 as shown in FIG. 8 should be integrally formed and made of resilient material having good elasticity of the biasing member 60 (the sleeve portion 62), whereby upon releasing of the strong wind W from the aperture A between the upper and lower cloths 2, 4, the resilience of the biasing member 60 of the control valve 6 will be automatically restored to close the aperture A between the upper and lower cloths 2, 4 (from FIG. 9 to FIG. 8).

So, the sleeve portion 62 of the control valve 6 is normally juxtapositioned to and approximated to the joint member 7 (FIG. 8).

The sleeve portion 62 is protruded outwardly from an inner portion of the joint member 7 to be generally parallel and juxtapositional to the joint member 7. The inner tip portion 41 of lower cloth 4 is secured on an inner portion of the joint member 7 and positioned below the sleeve portion 62 of the control valve 6 (FIG. 8).

The flap rib portion 32 of the upper rib 3 is made of resilient material for helping automatic restoring of the upper cloth (the outer flap portion 23) on the lower cloth 4 for closing the aperture A between the cloths 2, 4.

As shown in FIGS. 12~16, the present invention is further modified, which includes: an upper cloth 2 secured on an upper rib 3 having an inner rib portion 3*a* pivotally secured to the upper notch 11 on the central shaft 1, a lower cloth 4 secured on a lower rib 5 having an inner rib portion 5*a* pivotally secured to the upper notch 11, with the lower rib 5 positioned under and juxtapositioned to the upper rib 3. The outer rib portion 3*b* having the outer flap portion 23 of the upper cloth 2 secured thereon is protruded outwardly beyond the central opening 43 to allow the upper cloth 2 to close the central opening 43 formed on a top of the lower cloth 4.

Each upper rib 3 has a middle lug 3*c* between the inner rib portion 3*a* and an outer rib portion 3*b* for pivotally connecting a control valve 6 which includes: a linking member 6*b* pivotally connected with the middle lug 3*c* of the upper rib 3, a stretcher rib portion 6*a* having its inner end pivotally connected with the lower runner 12 and having an outer end of the stretcher rib portion 6*a* telescopically engageable with the linking member 6*b*, and a restoring spring 6*c* resiliently connecting the stretcher rib portion 6*a* and the linking member 6*b* for normally retracting the linking member 6*b* into the stretcher rib portion 6*a* for approximating the upper rib 3 to the lower rib 5 for closing the upper cloth 2 on the lower cloth 4 for closing the aperture between the upper and lower cloths 2, 4.

Each lower rib 5 has a middle lug 5*c* formed between an inner rib portion 5*a* and an outer rib portion 5*b* for pivotally connecting a stretcher rib portion 5*d* which is pivotally secured to the lower runner 12.

Figures 12, 13, 14:
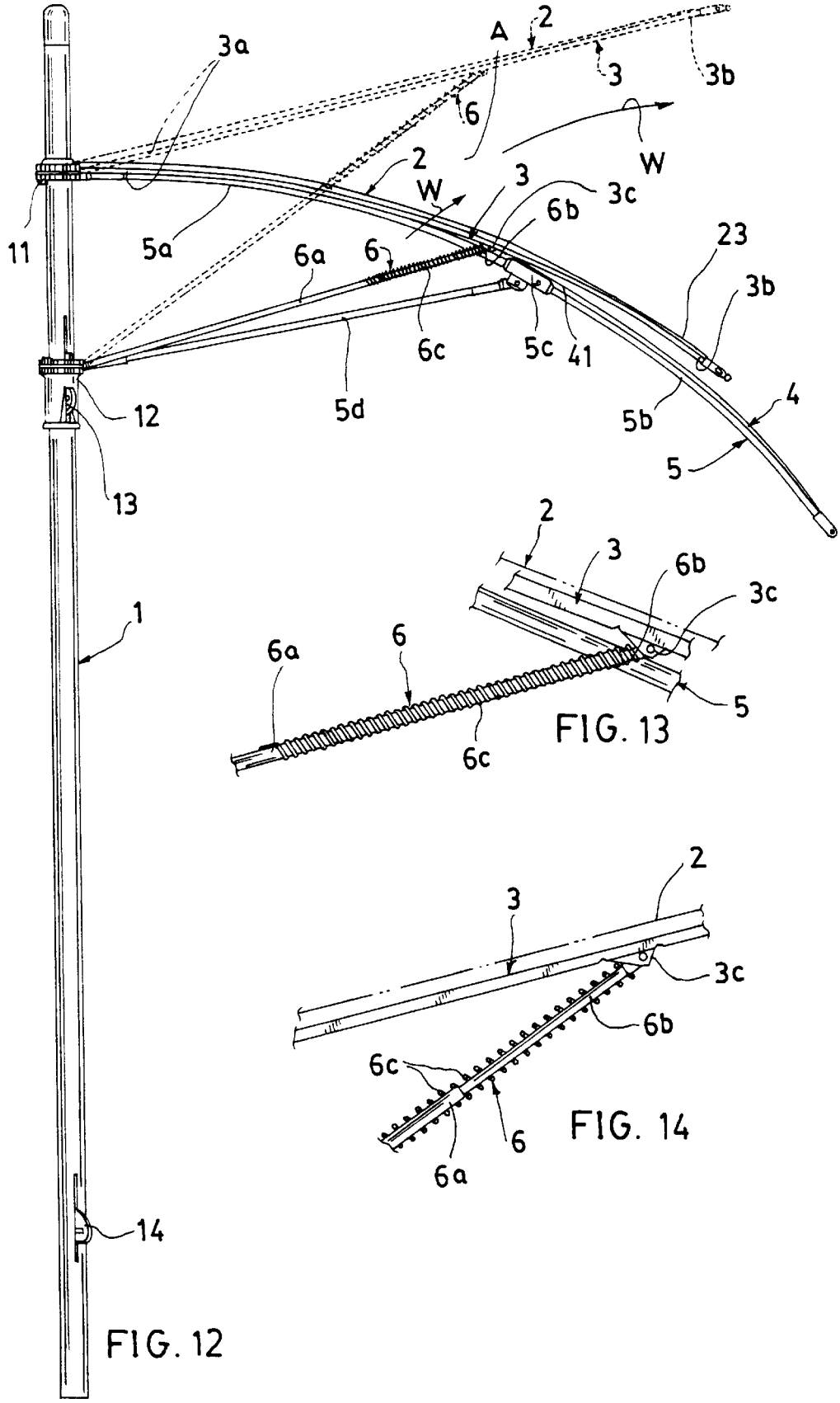
FIG. 12 shows still another preferred embodiment of the present invention when opened.
FIG. 13 shows a closed control valve of FIG. 12.
FIG. 14 shows an opened control valve of FIG. 12.
Figure 16:
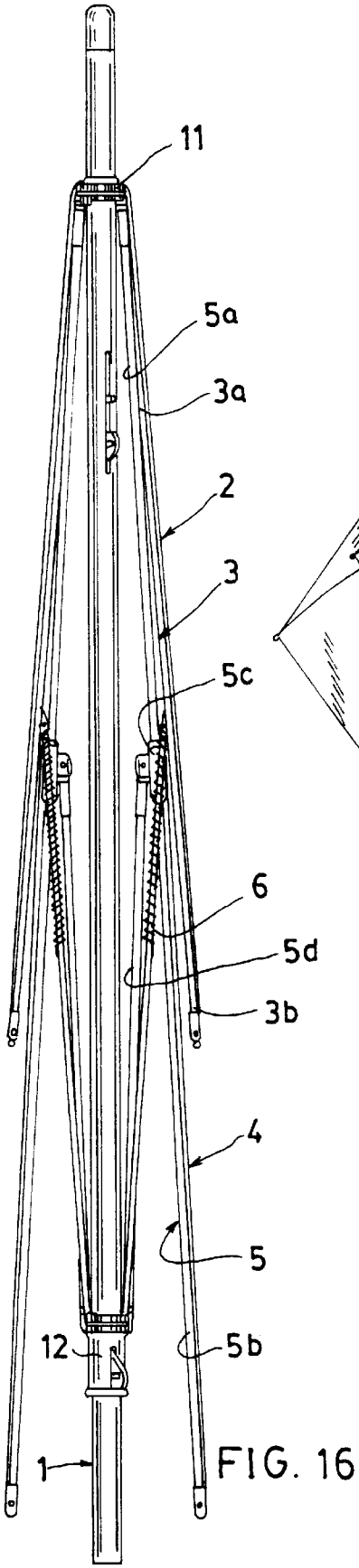
FIG. 16 shows a folded umbrella from FIG. 12.
Figure 15:
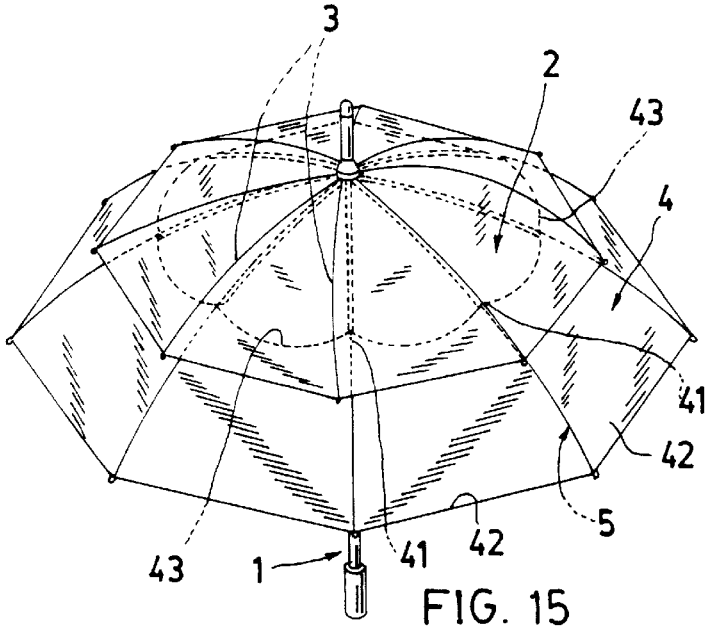
FIG. 15 is a perspective view of the present invention of FIG. 12.

Upon blowing of strong wind W to upwardly pull the upper cloth 2, the upper rib 3 and the linking member 6*b* from the stretcher rib portion 6*a*, the aperture A between the upper cloth 2 and the lower cloth 4 will be opened as shown in FIG. 14 and in dotted line of FIG. 12 to release the air from the aperture A to prevent inversion of the umbrella.

When the wind is gone, the restoring spring 6*c* of the control valve 6 will restore the linking member 6*b* to be retracted into the stretcher rib portion 6*a* to close the upper cloth 2 to the lower cloth 4 for closing the aperture A between the two cloths 2, 4.

The stretcher rib portion 6*a* may be formed as an outer tube to telescopically receive the linking member 6*b* which may be made as an inner tube.

The inner tip portion 41 of the lower cloth 4 is secured on the middle lug 5*c* of the lower rib 5.

Figures 17, 18, 19:
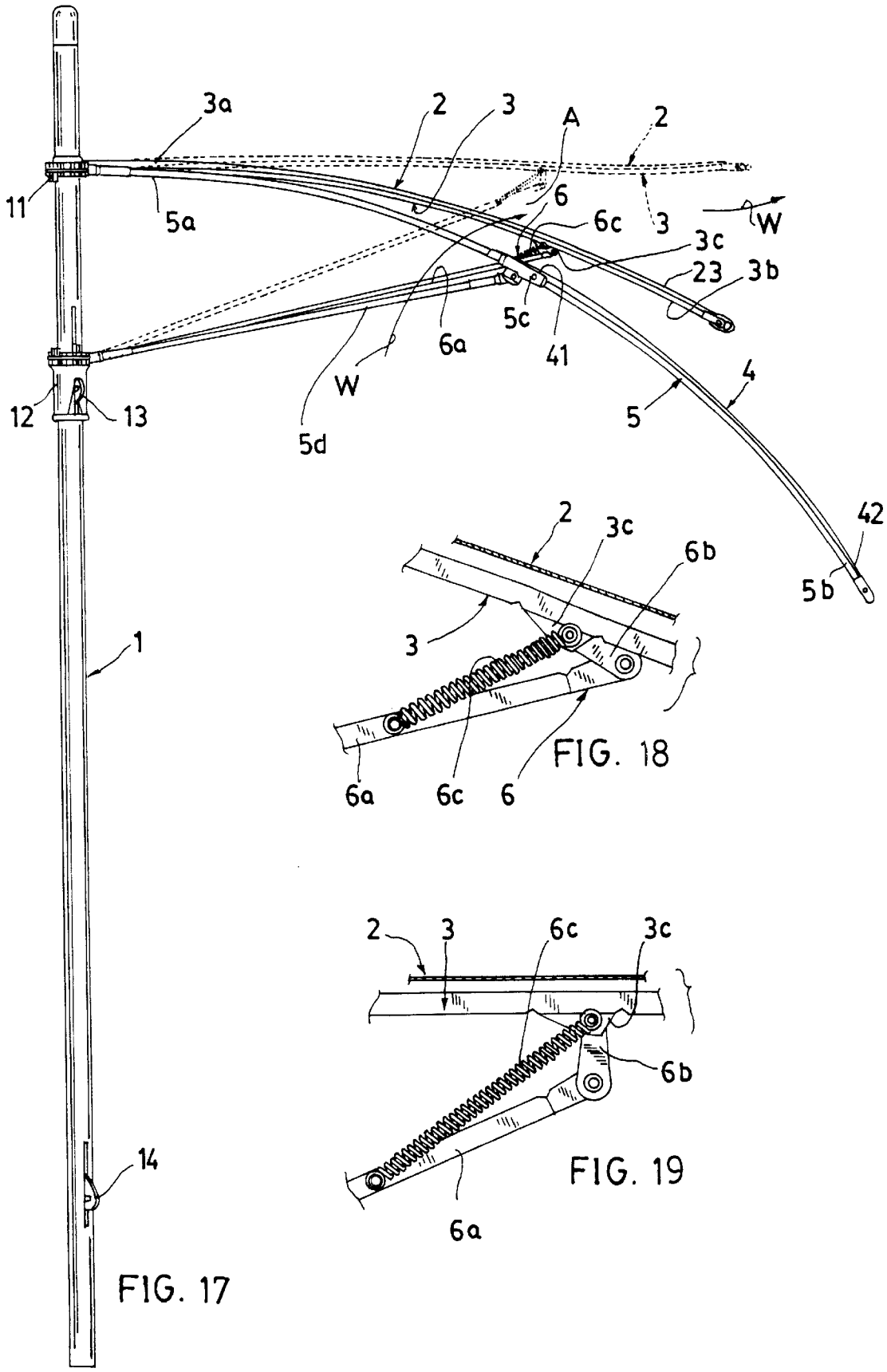
FIG. 17 shows further preferred embodiment of the present invention when opened.
FIG. 18 shows a closed control valve of FIG. 17.
FIG. 19 shows an opened control valve of FIG. 17.
Figure 21:
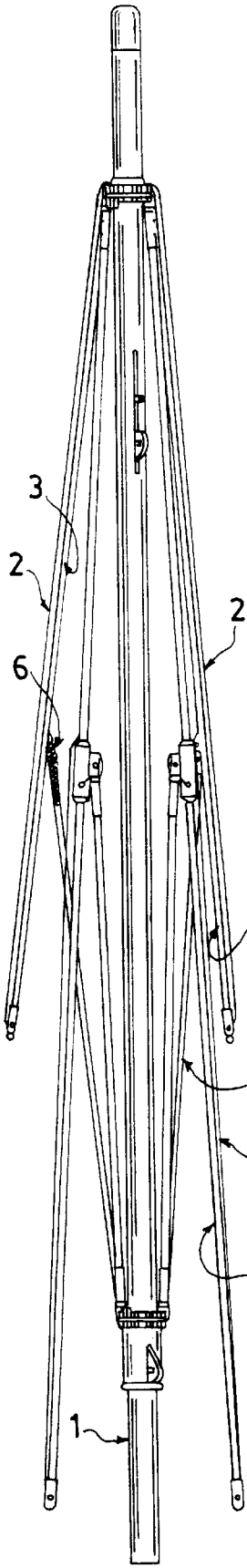
FIG. 21 shows a folded umbrella from FIG. 17.

As shown in FIGS. 17~21, still further preferred embodiment of the present invention is made as derived from the embodiment of FIGS. 12~14 by modifying the control valve 6 as shown in FIGS. 13, 14 to include: a stretcher rib portion 6*a* pivotally secured to the lower runner 12, a linking member 6*b* pivotally secured between the stretcher rib portion 6*a* and a middle lug 3*c* of the upper rib 3, and a restoring spring 6*c* resiliently connecting the linking member 6*b* with the stretcher rib portion for normally tensioning the linking member 6*b* to the stretcher rib portion 6*a* for closing the upper cloth 2 to the lower cloth 4 as shown in FIGS. 18, 17.

Upon wind blowing to pull the upper cloth 2 upwardly to extend the linking member 6*b* from the stretcher rib portion 6*a* (FIGS. 19, 17), the control valve 6 is opened to allow air escaping from the aperture A between the upper and lower cloths 2, 4. Afterwards, the restoring spring 6*c* will restore the linking member 6*b* towards the stretcher rib portion 6*a* as shown in FIGS. 18 and 17 to close the upper and lower cloths 2, 4.

Figure 20:
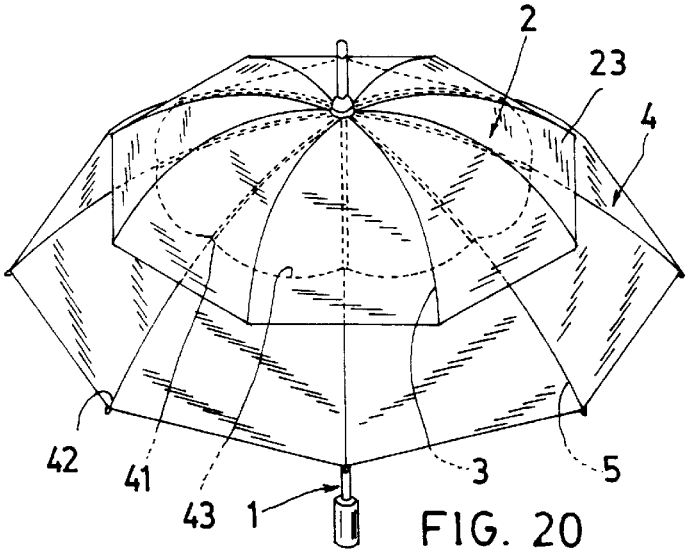
FIG. 20 is a perspective view of the present invention as shown in FIG. 17.
Figure 22:
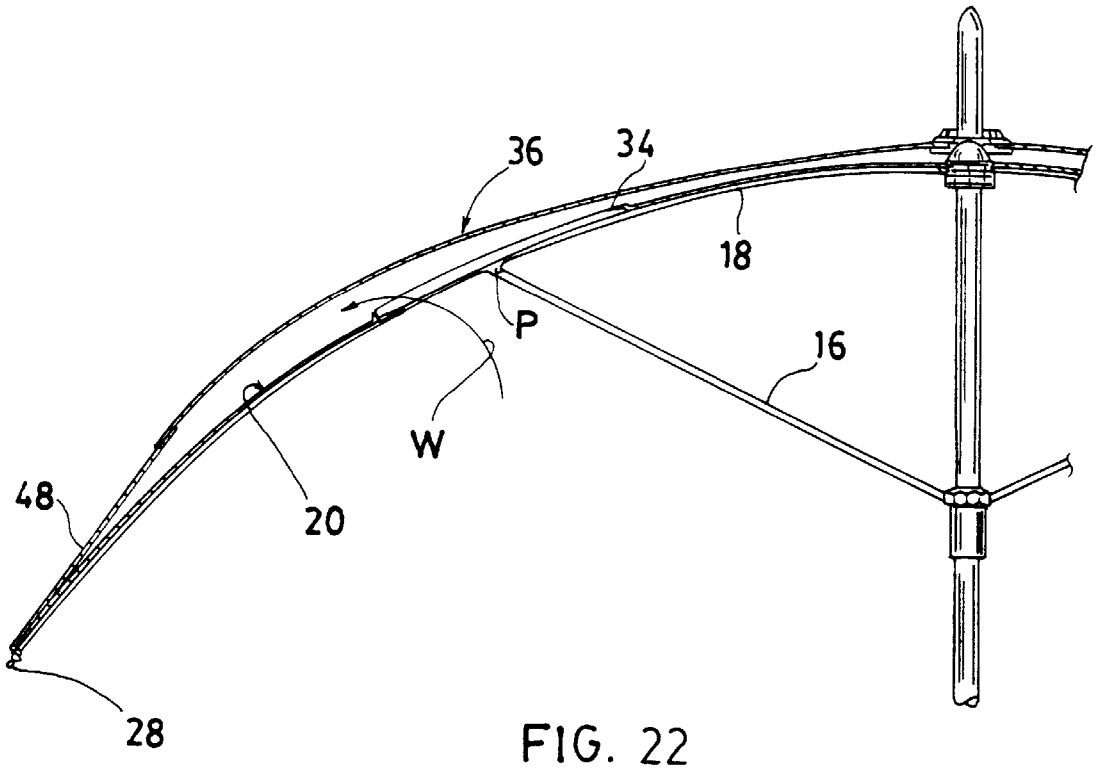
FIG. 22 PRIOR ART
FIG. 22 shows a prior art of a conventional windproof umbrella.

As shown in FIG. 20, the upper rib 3 may be projectively deviated from the lower rib 5 for forming a different design and decoration if plural colors are respectively formed on the "sectors" of the umbrella cloths 2, 4. Each ball tip (not shown) at the outer end of each upper rib 3 may be well clad by the upper cloth 2 to prevent pricking damage to the lower cloth 4.

The present invention may be further modified without departing from the spirit and scope of the present invention.

For instance, the umbrella ribs 3, 5 may be provided for multiple-fold umbrella, while the central shaft 1 may be consisting of a plurality of tubes telescopically engageable with one another.

The control valve 6 as shown in FIGS. 8, 2 may be made of elastomeric materials having good elasticity. The flap rib portion 32 of the upper rib may be formed with engineering plastic or reinforced plastic materials having good elasticity.

The "control valve" 6 as designated in the present invention is defined to express its control mechanism for opening or closing the aperture A between the upper cloth 2 and the lower cloth 4, like a "control valve" for opening or closing a water or air streamflow in fluid mechanics.

What is claimed is:

1. A windproof umbrella comprising:

a central shaft having an upper notch fixed on an upper portion of said shaft and a lower runner slidably held on said shaft;

an upper cloth secured on at least an upper rib which is pivotally connected to the upper notch of the central shaft;

a lower cloth secured on at least a lower rib which is pivotally connected to the central shaft, said lower cloth having a central opening circumferentially formed on a top of the lower cloth around said central shaft, and said upper cloth closing the central opening of said lower cloth; each said upper rib having an intermediate portion thereof connected with a control valve which is connected to said lower runner by a stretcher rib portion, said control valve resiliently restoring an outer rib portion of the upper rib having an outer flap portion of the upper cloth secured on said outer rib portion to approximate said lower rib for closing said upper cloth to said lower cloth for closing an aperture between said upper and lower cloths, whereby upon blowing of strong wind to pull said upper cloth and said upper rib upwardly, said control valve will be opened to open the aperture between said upper and lower cloths for releasing the air for preventing inversion of umbrella.

2. A windproof umbrella according to claim 1, wherein said upper rib has its outer rib portion protruding outwardly from said control valve not exceeding a half length of a radial length of said lower cloth between the central opening at the top of the lower cloth and a peripheral portion of the lower cloth.

3. A windproof umbrella according to claim 1, wherein said upper cloth has its inner portion secured to the upper notch of the central shaft, an intermediate portion secured on a top rib portion of the upper rib and the outer flap portion formed on an outer portion of the upper cloth to be secured on a flap rib portion of the upper rib; said lower cloth having its inner tip portion secured on a joint member provided for joining the top rib portion formed on the top portion of the upper rib and the lower rib, a peripheral portion secured on an outer rib portion of the lower rib, and said central opening circumferentially formed on the top portion of the lower cloth about the central shaft and closed by said control valve connected with the joint member.

4. A windproof umbrella according to claim 3, wherein said joint member includes an inner sleeve portion securing an outer end of the top rib portion of the upper rib, an outer sleeve portion securing an inner rib portion of the lower rib, a lug pivotally connecting said control valve and pivotally connecting an outer portion of the stretcher rib which is pivotally secured to the lower runner, said lower runner locked on an upper catch on said shaft when opening the umbrella and upwardly limited by a stopper formed on the shaft.

5. A windproof umbrella according to claim 4, wherein said control valve includes: a biasing member having a base portion pivotally connected to the lug of the joint member, a sleeve portion protruding from the base portion to be generally parallel to the outer sleeve portion of the joint member when the upper cloth closing the lower cloth, and a restoring spring secured on an inner portion of the sleeve portion and fixed to the inner sleeve portion of the joint member by a retainer for resiliently urging the sleeve portion to be closely juxtapositioned to the outer sleeve portion of the joint member for closing said upper cloth on said lower cloth; said sleeve portion of the control valve fixed therein with an inner end of said flap rib portion formed on the outer portion of the top rib portion of the upper rib, having an outer flap portion of the upper cloth secured on the flap rib portion.

6. A windproof umbrella according to claim 5, wherein said restoring spring of the control valve is formed in situ by directly extending the inner end of the flap rib portion inwardly to be retained on the retainer fixed on the joint member, the flap rib portion having a length being less than one half of a radial length of the lower cloth from the central opening to the peripheral portion of the lower cloth; said flap rib portion of the upper rib made of resilient material having elasticity.

7. A windproof umbrella according to claim 4, wherein said top rib portion of the upper rib and the lower rib are integrally formed as a linear rod.

8. A windproof umbrella according to claim 4, wherein said control valve includes a biasing member having a base portion integrally formed on a top of the joint member, and having a sleeve portion protruding from the base portion and securing the flap rib portion formed on the outer portion of the upper rib into the sleeve portion.

9. A windproof umbrella according to claim 8, wherein said control valve and the joint member are integrally formed and made of resilient material having elasticity for making the biasing member and the sleeve portion of the control valve to be resilient, whereby upon releasing of a strong wind from an aperture between the upper cloth and the lower cloth, said biasing member of the control valve will be automatically restored to close the aperture between the upper and lower cloths.

10. A windproof umbrella according to claim 9, wherein said sleeve portion of the control valve is protruded outwardly from an inner portion of the joint member to be generally parallel and juxtapositional to the joint member; an inner tip portion of the lower cloth secured on an inner portion of the joint member and positioned below the sleeve portion of the control valve.

11. A windproof umbrella according to claim 8, wherein said flap rib portion of the upper rib is made of resilient material for helping automatic restoring of the upper cloth on the lower cloth for closing the aperture between the upper and lower cloths.

* * * * *